US009527286B2

(12) United States Patent
Sakata et al.

(10) Patent No.: US 9,527,286 B2
(45) Date of Patent: Dec. 27, 2016

(54) PRINT APPARATUS AND PRINT METHOD

(71) Applicant: CANON KABUSHIKI KAISHA, Tokyo (JP)

(72) Inventors: Yaado Sakata, Yokohama (JP); Hideaki Kutsuna, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/877,751

(22) Filed: Oct. 7, 2015

(65) Prior Publication Data

US 2016/0101622 A1 Apr. 14, 2016

(30) Foreign Application Priority Data

Oct. 10, 2014 (JP) ..... 2014-209013

(51) Int. Cl.
*B41J 2/165* (2006.01)
*B41J 2/155* (2006.01)

(52) U.S. Cl.
CPC ..... *B41J 2/165* (2013.01); *B41J 2/155* (2013.01); *B41J 2/16505* (2013.01); *B41J 2/16552* (2013.01); *B41J 2/16585* (2013.01)

(58) Field of Classification Search
CPC ..... B41J 2/155; B41J 2/165; B41J 2/16505; B41J 2/16552; B41J 2/16585
See application file for complete search history.

(56) References Cited

U.S. PATENT DOCUMENTS 6,536,863 B1 * 3/2003 Beauchamp ..... B41J 29/377 347/17
2002/0167576 A1 * 11/2002 Koitabashi ..... B41J 2/1714 347/101
2007/0229611 A1 * 10/2007 Nagashima ..... B41J 2/175 347/84
2010/0066787 A1 3/2010 Yokouchi
2011/0181658 A1 * 7/2011 Izawa ..... B41J 2/155 347/34
2011/0211030 A1 * 9/2011 Nitta ..... B41J 3/60 347/102
2012/0162311 A1 6/2012 Taira

FOREIGN PATENT DOCUMENTS

JP 2005-271314 A 10/2005
JP 2008114511 A 5/2008
JP 2011-235468 A 11/2011
WO 2013047234 A1 4/2013

* cited by examiner

*Primary Examiner* — Stephen Meier
*Assistant Examiner* — Alexander D Shenderov
(74) *Attorney, Agent, or Firm* — Canon USA, Inc. IP Division

(57) ABSTRACT

Humidified gas generated by a humidifying unit is supplied to a space between two adjacent print heads from one side of the space, and the humidified gas supplied to the space is discharged from the other side facing the one side across the space.

15 Claims, 10 Drawing Sheets

PRINT APPARATUS AND PRINT METHOD

BACKGROUND OF THE INVENTION

Field of the Invention

The present invention relates to an inkjet-type print apparatus which suppresses drying of nozzles by supplying humidified gas.

Description of the Related Art

In a general inkjet print apparatus, if nozzles are not driven for a long period of time, defective ejection occurs due to thickening caused by evaporation of solvent (moisture) of ink in the nozzles. To avoid this problem, a method for supplying high-humidity gas to portions near the nozzles is employed.

Japanese Patent Laid-Open No. 2011-235468 discloses a configuration in which humidified gas is supplied from an upstream of a plurality of arranged print heads so that the humidified gas flows to gaps between the print heads and a sheet (print gaps) along a direction in which the sheet is conveyed.

In this configuration, the humidified gas is successively supplied to the print gaps of the individual print heads which are arranged along the sheet conveyance direction. Therefore, a long period of time is required until the humidified gas reaches a downstream side. Furthermore, to supply the humidified gas to the narrow print gaps having a large flow resistance in a short time, a high supply pressure of a supply unit which supplies the humidified gas is required. Furthermore, to obtain the high supply pressure, the supply unit which supplies the humidified gas is required to have high power, and accordingly, the size of an apparatus is increased and noise is increased. In addition, a speed of airflow is increased in the narrow print gaps, and accordingly, ejection of ink from the heads may be deviated.

On the other hand, in an example illustrated in FIG. 17 of Japanese Patent Laid-Open No. 2005-271314, humidified gas is supplied from a side to a certain space between adjacent two of a plurality of aligned print heads. The supplied humidified gas passes through one of the gaps between the print heads and a sheet (print gaps) to a next space so as to be discharged from the certain space. In both of the disclosures, humidified gas is supplied to print gaps so that nozzles are prevented from being dried.

In the configuration in Japanese Patent Laid-Open No. 2005-271314, since the humidified gas supplied from the side to the certain space is supplied through a narrow print gap to the next space, a long period of time is required until the humidified gas spreads. Furthermore, a high supply pressure of the humidified gas is required. Moreover, two ducts, that is, a supply duct and a discharge duct, are disposed in one space positioned between adjacent print heads, and accordingly, a large channel cross-section area may not be ensured resulting in increase of a channel resistance. This also causes increase of the supply pressure of the humidified gas. That is, the configuration in Japanese Patent Laid-Open No. 2005-271314 also has a problem the same as that of the configuration in Japanese Patent Laid-Open No. 2011-235468.

The present invention provides a print apparatus which suppresses drying of nozzles by supplying humidified gas in a short time without increasing a supply pressure.

SUMMARY OF THE INVENTION

The present invention provides a print apparatus including a print unit configured to include a plurality of inkjet-type print heads, a conveying unit configured to move a sheet for printing to be performed by the print unit, and a supply unit configured to supply humidified gas to a space between two adjacent print heads. The supply unit includes a humidifying unit configured to generate the humidified gas, a supply port which is used to supply the humidified gas generated by the humidifying unit from a side of the space, and a discharge port which is disposed so as to face the supply port across the space and which is used to discharge the gas from the space.

Further features of the present invention will become apparent from the following description of exemplary embodiments with reference to the attached drawings.

DESCRIPTION OF THE EMBODIMENTS

Before an embodiment of the present invention is described in detail, problems of related arts and a basic concept of the present invention will be described.

Problems

Figure 7A:
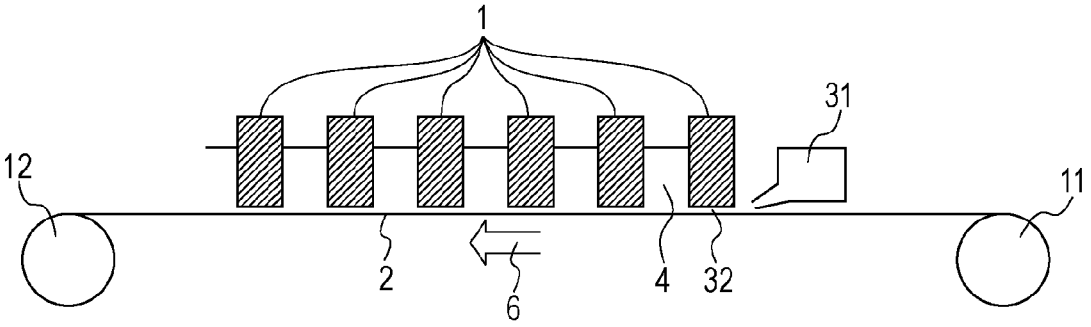
FIGS. 7A and 7B are diagrams illustrating a problem in a related art.

In Japanese Patent Laid-Open No. 2011-235468, a humidifying unit 31 is disposed on an upstream side of head units 1 as illustrated in FIG. 7A. Humidified gas supplied from the humidifying unit 31 encounters one of the head units 1 which is located on the most upstream side, passes a print gap 32 (a small gap between a head and a sheet), and is supplied to a space on a downstream side. This operation is repeatedly performed so that the humidified gas is successively supplied to the downstream side.

Figure 7B:
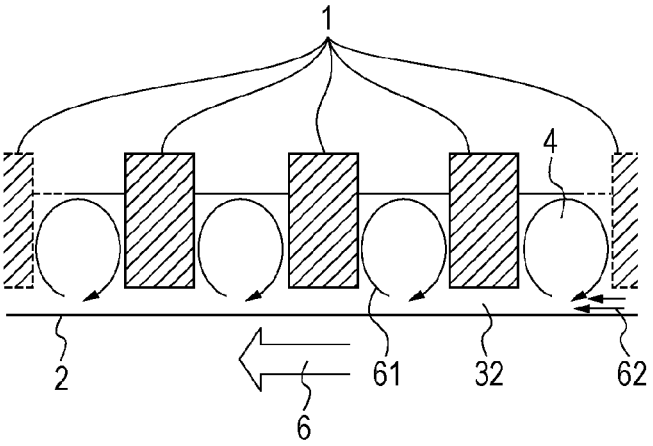

As illustrated in FIG. 7B, a current 61 is generated in a space 4 between adjacent two of the head units 1 due to an effect of shear of a flow 62 in a boundary layer formed by sheet conveyance. The flow 62 in the boundary layer supplied from the upstream side is taken into the current 61.

The humidified gas supplied from the humidifying unit 31 positioned on the most upstream side flows to the most downstream side through a plurality of print gaps 32 which have a large channel resistance. Therefore, the humidifying unit 31 is required to increase a supply pressure of the humidified gas, and accordingly, a large blast fan of high power or the like is required. In addition, since the print gaps 32 are narrow, the humidified gas flows through the print gaps 32 at high speed toward the downstream side. Therefore, ejection of ink droplets are affected by the high-speed humidified gas and positions of applying of the ink droplets on the sheet are shifted from appropriate positions. Accordingly, color unevenness or distortion of an image may be generated.

Figure 8A:
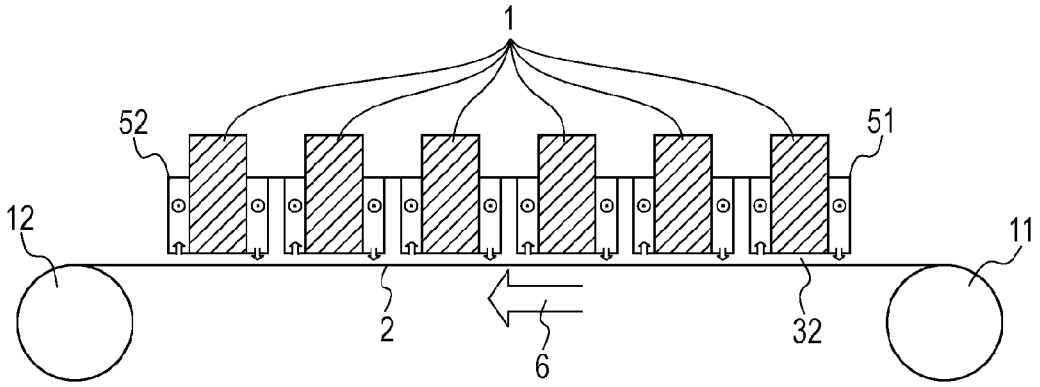
FIGS. 8A and 8B are diagrams illustrating a problem in another related art.
Figure 8B:
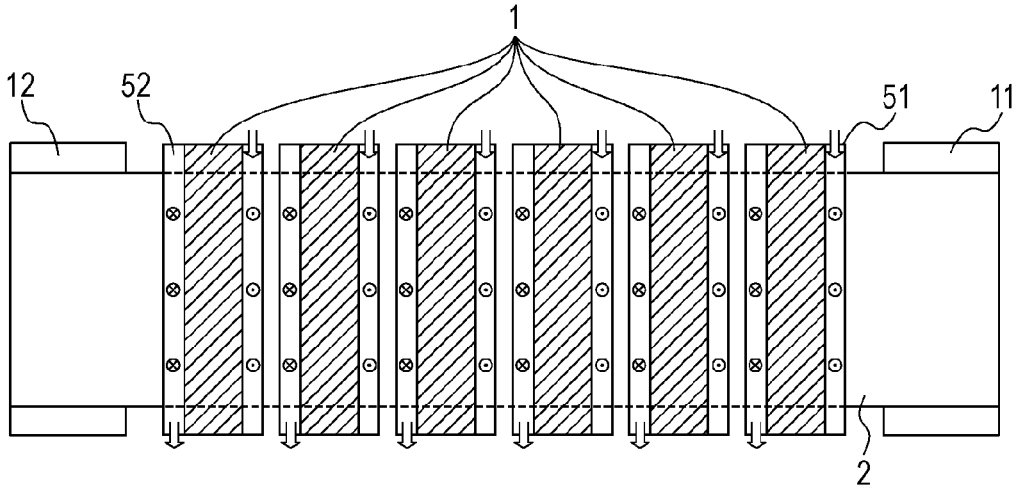

In Japanese Patent Laid-Open No. 2005-271314 (the example illustrated in FIG. 17 of Japanese Patent Laid-Open No. 2005-271314), as illustrated in FIGS. 8A and 8B, supply ducts 51 for supplying humidified gas are disposed on upstream sides of individual head units 1, and discharge ducts 52 are disposed on downstream sides of the individual head units 1. Specifically, two ducts are disposed in one space. The humidified gas supplied to a certain space from a supply duct 51 passes through a print gap 32 to a next space and collected by a discharge duct 52. In this configuration, the humidified gas introduced into the certain space is discharged only after passing the narrow print gap 32, and therefore, a channel resistance in the print gap is large. A channel of the supply duct 51 is configured such that the supply duct 51 bends at a right angle, and accordingly, the channel resistance is further increased. Furthermore, since both of the supply duct 51 and the discharge duct 52 are included in one space, a large channel cross-section may not be obtained, and accordingly, the channel resistance is further increased. As a result, a problem which is the same as that of Japanese Patent Laid-Open No. 2011-235468 arises. Specifically, the humidified gas is required to be supplied by a high supply pressure so that the humidified gas is introduced in a short time, and in addition, since a speed of airflow in the print gaps is high, ejection of ink droplets are easily affected by the high-speed airflow.

Concept of Invention

The problems to be solved by the present invention are described hereinabove. A first point of the present invention is that humidified gas is supplied to a space between a first print head and a second print head which are adjacent to each other from one side of the space. A second point of the present invention is that the gas in the space is discharged from the other side which faces the supply side across the same space. Since the supply and the discharge of the humidified gas are simultaneously performed from both sides in the same space, the straight airflow is generated in the space and the space is filled with the humidified gas in a short time.

Figure 9A:
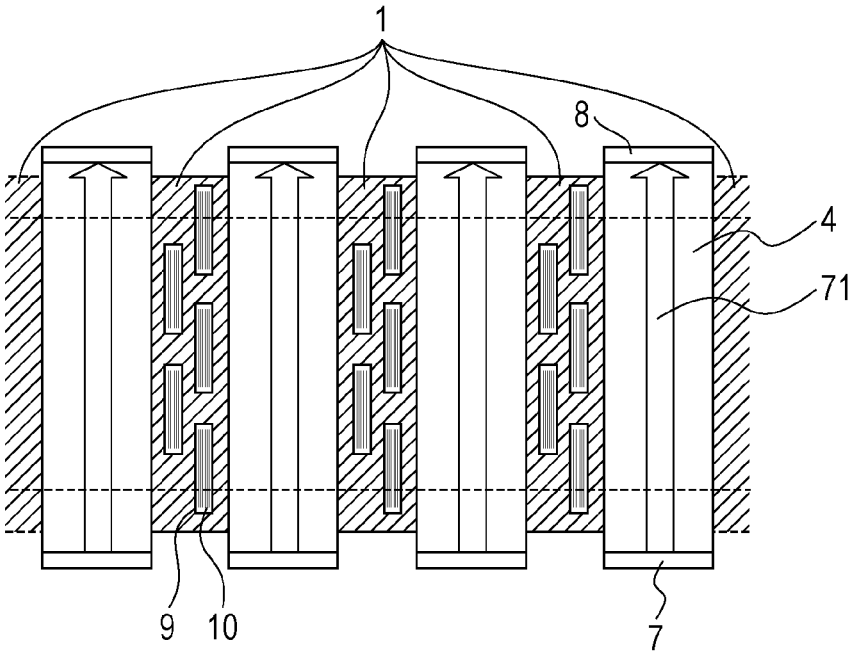
FIGS. 9A and 9B are diagrams illustrating a concept of the present invention.

Specifically, as illustrated in FIG. 9A, humidified gas is supplied from a supply port 7 which is a supply section of the humidified gas to a space 4 between two adjacent print heads, that is, supplied from one side of the space 4. As illustrated in a cross-sectional view of FIG. 9B, the humidified gas flows in a depth direction of a page of FIG. 9B from a front portion in a vertical direction of the page of FIG. 9B (denoted by a reference numeral 71). Then the gas in the space 4 is discharged from a discharge port 8 which is disposed on the other side facing the supply port 7 in the same space 4. Since, while the humidified gas is introduced into the straight space 4 which has no obstacle from one side, the humidified gas is discharged from the other side, a straight airflow is generated in the space 4 and low-humidity air initially included in the space 4 is replaced by the humidified gas in a short time. The number of spaces 4 changes depending on the number of print heads 1, and the same supply and the same discharge of humidified gas are performed in all the spaces 4.

Note that, in this specification, the term "side" in the space 4 represents an outside which is adjacent to the space 4 in a direction orthogonal to the sheet conveyance direction within a plane which is parallel to the sheet. That is, the term "side" represents the outside of the space 4 in a longitudinal direction of the long and narrow space 4. In other words, the term "side" represents each of ends of a print head in a nozzle formation direction of a line head.

As described above, a sheet 2 is moved in a direction denoted by an arrow mark 6 in a state in which the spaces 4 are filled with the humidified gas. Then a laminar flow 62 is generated in accordance with the movement of the sheet 2, and the humidified gas is introduced into print gaps 32 (gaps between the nozzles and the sheet 2). In this way, the spaces 4 in which the nozzles are exposed are humidified, and accordingly, the nozzles are prevented from being dried.

Since the entire spaces 4 serve as channels, the straight channels which have large channel cross-section areas and which do not bend are obtained. By this, a flow of a small channel resistance and a small pressure drop may be formed. Due to synergy between the reduction of the channel resistance (pressure drop) and simultaneous performance of the supply and the discharge of the humidified gas, the entire spaces 4 may be filled with the humidified gas in a short time.

This function effect is confirmed by hydrodynamic theory. Assuming that the pipe space 4 is a pipe line in which fluid flows, a channel resistance of the pipe line is represented by a pipe friction coefficient. In a case where the fluid flows in the pipe having a rectangle cross-section in a laminar flow state, a pressure drop ΔP may be obtained by an expression below. Here, "λ" denotes the pipe friction coefficient of Darcy, "Δx [m]" denotes a length of the pipe channel, "ρ [kg/m$^2$]" denotes a density of the fluid, "ν [m$^2$/s]" denotes a dynamic viscosity coefficient, "μ [m/s]" denotes an average flow velocity in the pipe line, "$D_H$ [m]" is obtained as a ratio of a cross-section area to a length of a periphery, and "V [m$^2$/s]" denotes a flow rate.

$$\Delta P = \lambda \frac{\Delta x}{D_H} \frac{\rho u^2}{2} = \frac{128 \rho \upsilon V \Delta x}{\pi D_H^4} \qquad \text{Math 1}$$

According to the expression above, the channel resistance of the rectangle pipe is proportional to 1/the fourth power of a hydraulic diameter $D_H$ [m]. As described above, in a case where the fluid flows in the pipe line under a condition in which a flow rate is constant, the pressure drop may be reduced by using a channel having a diameter as large as possible and energy consumption of a power source may be suppressed. In other words, in the same energy consumption amount, when a channel having a diameter as large as possible is used, a larger amount of fluid may flow, and accordingly, high efficiency is attained.

As for the channel resistance which is changed depending on a shape of a pipe, the pressure drop ΔP is defined as below using a loss coefficient C.

$$\Delta P = C \frac{\rho u^2}{2} \qquad \text{Math 2}$$

In a bending pipe line which is not straight, the loss coefficient C is changed depending on a cross-section shape or an angle, and the loss coefficient C becomes maximum when the pipe line bends at a right angle relative to a flowing direction. Accordingly, it is preferable that the spaces 4 which are pipe lines are straight and change of flowing directions due to shapes of the ducts are small so that the channel resistances are reduced.

Figure 9B:
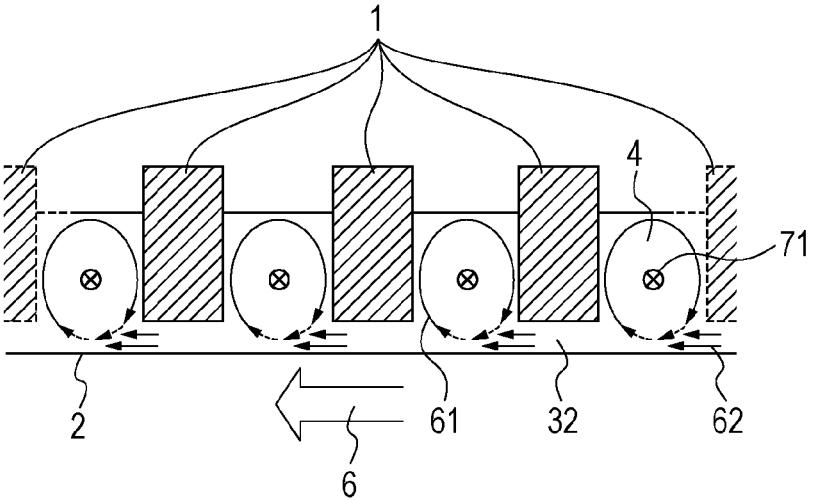

As illustrated in FIG. 9B, the humidified gas flowing in the spaces 4 are supplied to the print gaps 32 due to the relationship between the currents 61 and the flow 62 in the boundary layer formed on a surface of the sheet 2 in accordance with the conveyance of the sheet 2. A speed of the airflow does not largely exceed a sheet conveyance speed, and accordingly, influence of the airflow on the ejection of the ink is negligible.

According to the concept of the present invention, humidified gas may be supplied in a short time without increasing a supply pressure of the humidified gas and drying of nozzles is efficiently suppressed. Consequently, a downsized print apparatus which ensures high-quality printing for a long period of time and which has high print throughput is realized.

Embodiment

An embodiment of an inkjet print apparatus according to the present invention will be described. This embodiment is applicable to not only the print apparatus of the present invention but also apparatuses using inkjet heads. Furthermore, the present invention is applicable to not only print apparatuses employing inkjet heads but also print apparatuses employing print heads in which performance thereof is degraded due to drying.

Figure 1A:
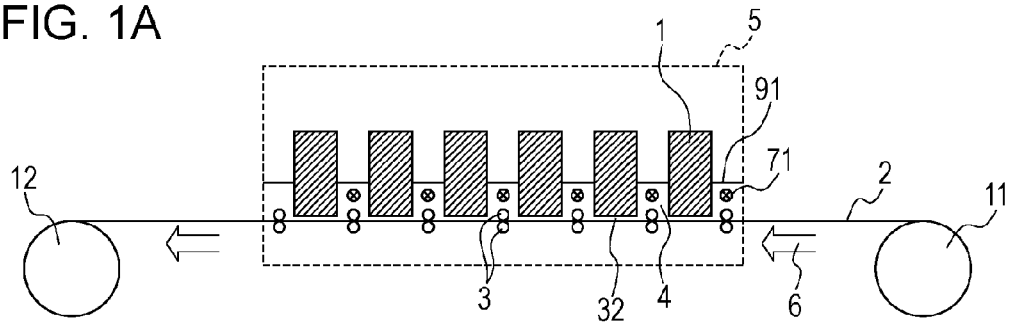
FIGS. 1A to 1C are diagrams illustrating a configuration of a print apparatus according to an embodiment of the present invention.
Figure 1B:
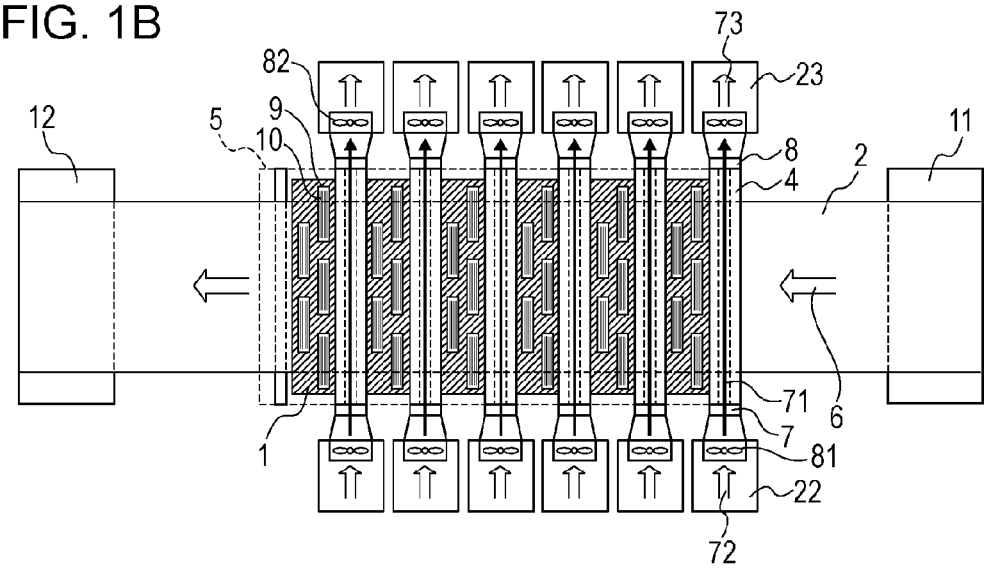
Figure 1C:
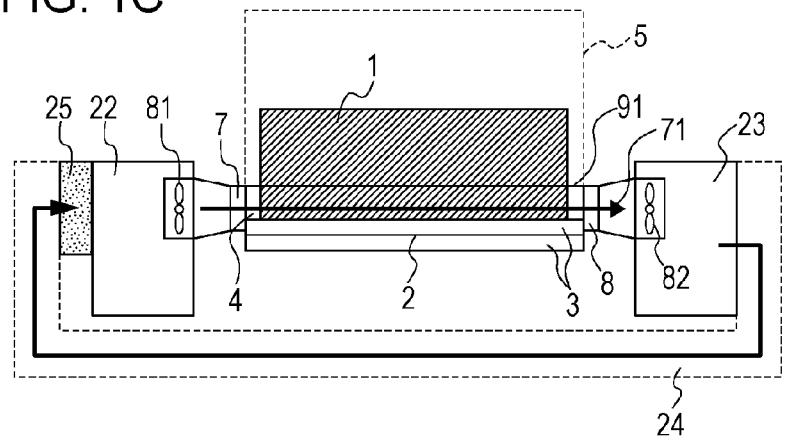

FIGS. 1A to 1C are diagrams illustrating an entire configuration of the print apparatus. Specifically, FIG. 1A is a cross-sectional view from a side, FIG. 1B is a cross-sectional view from a top, and FIG. 1C is a cross-sectional view from an upstream side in a sheet conveyance direction.

The configuration roughly includes a sheet supply unit 11, a print unit 5, and a sheet winding unit 12. The print apparatus performs high-speed color printing using a plurality of line heads while conveying a continuous sheet by a roll-to-roll system. A rolled continuous sheet 2 is drawn from the sheet supply unit 11. An image is printed while the drawn sheet 2 is conveyed by pairs of rollers 3 included in a conveying unit in the print unit 5. The printed sheet 2 is wound in a roll shape again by the sheet winding unit 12. Note that the continuous sheet is not limited to the rolled continuous sheet, and a continuous sheet which is folded by each unit length may be employed or sheets cut by a prescribed size may be successively conveyed.

In the print unit 5, a plurality of head units 1 corresponding to different ink colors (six colors in this embodiment) are arranged in the sheet conveyance direction (denoted by an arrow mark 6). The pairs of rollers 3 (the conveying unit) which sandwich the sheet in a vertical direction and convey the sheet are disposed between the adjacent head units 1. A plurality of nozzle chips 9 are alternately disposed in a staggered pattern in bottom surfaces of the individual head units 1 (surfaces facing the sheet 2). Each of the nozzle chips 9 includes a certain unit of nozzle arrays 10 which eject ink by an inkjet system. Note that the nozzle chips 9 may be arranged in series instead of the staggered manner. Alternatively, one nozzle array may be formed in entire printing range of a print head. Although the nozzle chips 9 and the nozzle arrays 10 are illustrated in FIG. 1B for facilitating understanding of the positional relationship, the nozzle chips 9 and the nozzle arrays 10 are disposed on lower surfaces of the head units 1 so as to face the sheet 2.

The plurality of head units 1 are held in the same posture by a shared head holder 91. A plurality of openings into which the head units 1 are to be inserted are formed in the head holder 91. In a state in which the head units 1 are inserted into the openings, gaps between side surfaces of cases of the head units 1 and the openings are sealed by an elastic member. Accordingly, humidified gas described below is prevented from leaking upward.

The spaces 4 are formed between the adjacent head units 1. Since six head units 1 are disposed in this embodiment, five independent spaces 4 are formed. Each of the spaces 4 is sandwiched between the side surfaces of the cases of corresponding two of the head units 1 from an upstream side and a downstream side in the sheet conveyance direction, and is sandwiched between the head holder 91 and the sheet 2 or a platen which supports the sheet 2 from an upper side and a lower side (a ceiling side and a bottom side), respectively. The spaces 4 are long and narrow flowing spaces in which a nozzle arrangement direction of the print heads corresponds to a longitudinal direction. Note that a long and narrow space 4 is similarly formed in a portion between one of the head units 1 which is positioned in the most upstream side and an inner surface of the case of the print unit 5. Therefore, six independent long and narrow spaces 4 exist in total.

Humidified gas of humidity higher than that in an environment in which the print apparatus is installed is supplied to the individual spaces 4 so as to suppress drying of the nozzles of the head units 1. Humidified gas generated in a humidifying unit 22 described below is introduced into the spaces 4 positioned between the adjacent head units 1 from sides of the spaces 4 so that the spaces 4 are filled with the humidified gas. When the sheet 2 is moved, a flow in a boundary layer is generated on the sheet surface in accordance with the movement, and the humidified gas flows in the narrow print gaps 32. By this, the nozzles of the nozzle chips 9 exposed to the print gaps 32 are covered by the humidified gas, and accordingly, the nozzles are moisturized.

Figure 2:
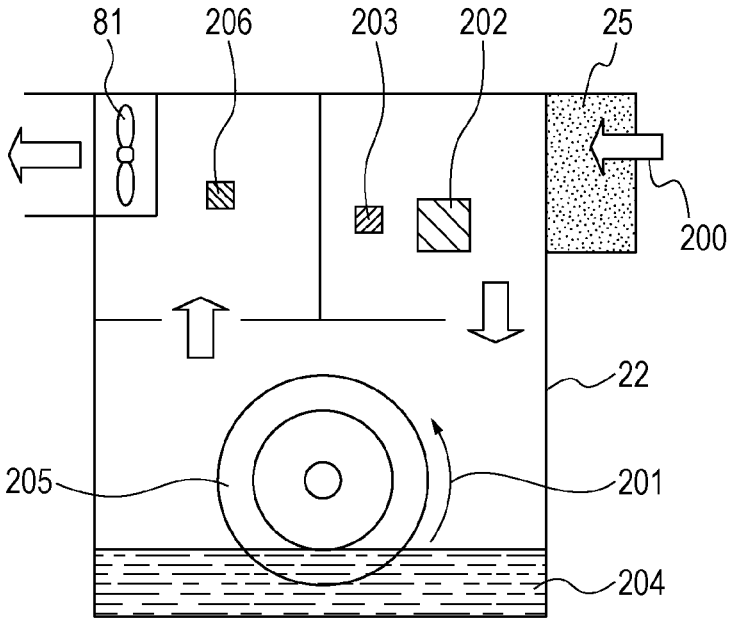
FIG. 2 is a diagram illustrating a configuration of a humidifying unit.

FIG. 2 is a diagram illustrating a configuration of the humidifying unit 22. The humidifying unit 22 generates humidified gas by a vaporization method. Specifically, the humidifying unit 22 includes a disk 205 which is formed of a water-absorbing member having a high water-absorbing property or which is formed by attaching a water-absorbing member, and the disk 205 is rotated by a driving mechanism. A lower portion of the disk 205 is in contact with water 204 which is stored in the humidifying unit 22. When the disk 205 is rotated, the entire water-absorbing member gradually absorbs water. Clean gas from which dust and foreign substances are removed by a filter 25 is introduced into the humidifying unit 22 by a supply fan 81. The introduced gas is heated by a heating element 202, and thereafter, the gas encounters the rotating disk 205. Some of the water in the water-absorbing member joins to the gas, and in this way, humidified gas is generated. Humidification capability of the humidifying unit 22 is controllable by changing a rotation speed of the disk 205 and a rotation speed of the supply fan 81. A controller 102 performs feedback control on the humidifying unit 22 in accordance with results of detections using a temperature sensor 203 and a humidity sensor 206 so as to operate the humidifying unit 22 such that the humidifying unit 22 generates humidified gas having appropriate temperature and appropriate humidity. Note that the humidifying unit 22 is not limited to this mode, and other general types of humidifying unit 22 may be used, such as a vaporization type, a water-spray type, and a steam type. The vaporization type includes, in addition to the rotation type, a moisture permeable membrane type, a drip permeation type, and a capillary type. The water-spray type includes an ultrasonic type, a centrifugal type, a high-pressure spray type, and twin-fluid atomization type. The steam type includes a steam-piping type, an electric-heating type, and an electrode type. Note that, although humidified air is used as the humidified gas in this example, gas other than air may be used as long as the nozzles are prevented from being dried.

Referring back to FIGS. 1A to 1C, the description is continued. The humidified gas generated by the humidifying units 22 becomes airflows in the fans 81 and is supplied from supply ports 7 to the spaces 4. The supply ports 7 are disposed on one side of the head units 1, and the humidified gas discharged from the supply ports 7 to the spaces 4 smoothly flows in the spaces 4 in the nozzle array direction of the head units 1 (a direction in which the nozzle chips 9 are arranged). The gas in the spaces 4 straightly flows in the longitudinal direction when the sheet 2 is stopped whereas the gas in the spaces 4 straightly flows in the longitudinal direction, and in addition, currents are generated due to a movement of the sheet 2 when the sheet 2 is conveyed.

Furthermore, in each of the spaces 4, a discharge port 8 is disposed in a position facing the supply port 7 so that the space 4 is sandwiched between the supply port 7 and the discharge port 8. A discharge fan 82 is also disposed at an end of the discharge port 8 so as to actively discharge the humidified gas to a collecting unit 23. The humidifying unit 22, the fan 81, the supply port 7, the discharge port 8, the fan 82, and the collecting unit 23 constitute a supply system (a supply unit) which supplies the humidified gas to and discharges the humidified gas from the space 4.

When the supply system is operated, in each of the spaces 4, the humidified gas is supplied from the supply port 7 to the space 4 and is discharged through the discharge port 8 from the space 4 so that the space 4 is filled with the humidified gas in a short time. In addition, the space 4 is a straight gas-flowing space having a large cross section and a flow resistance is small. Accordingly, the humidified gas may flow without a high supplying pressure.

As illustrated in FIGS. 7A and 7B, in the general mode in which humidified gas successively flows in a plurality of spaces from an upstream side to a downstream side, since a flow resistance is increased every time the humidified gas passes through a narrow print gap, a high supplying pressure is required on the upstream side, and a long period of time is required for entirely spreading the humidified gas. On the other hand, the spaces 4 have a small flow resistance in this embodiment and the humidified gas is supplied to the individual spaces 4 from one side. Accordingly, all the spaces 4 are filled with the humidified gas in a short time and a high supplying pressure is not required. In addition, since the humidified gas is supplied from the supply ports 7 and actively discharged from the discharge ports 8, the humidified gas is more efficiently introduced.

As illustrated in FIG. 1C, the humidified gas discharged from the discharge port 8 is supplied through a circulation duct 24 which connects the collecting unit 23 and the filter 25 of the humidifying unit 22 to each other to the humidifying unit 22 and is reused for generation of humidified gas in the humidifying unit 22. Specifically, the supply system realizes high energy use efficiency by a recycle system of the humidified gas. Note that the recycle of the humidified gas is not essential in the present invention, and the humidified gas discharged from the discharge port 8 may be discarded.

As described above, the humidified gas in the spaces 4 is gradually introduced into the print gaps in accordance with the movement of the sheet 2. A speed of the introduction does not largely excess a speed of the movement of the sheet 2. Therefore, ink droplets ejected from the nozzles for printing are not affected by airflow, and accordingly, impact positions are not shifted. Consequently, excellent image forming may be performed.

Figure 3:
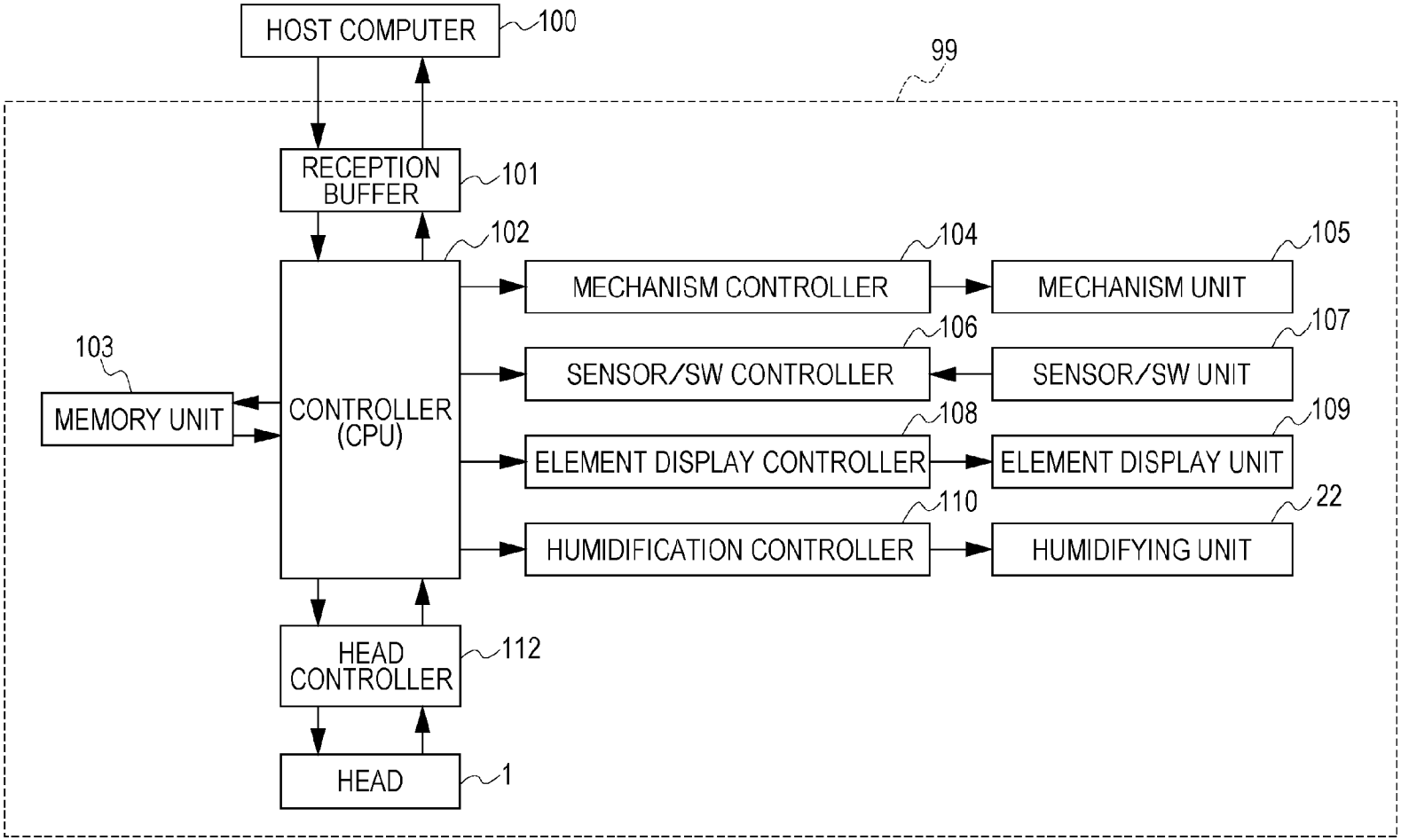
FIG. 3 is a block diagram illustrating a control system.

FIG. 3 is a block diagram illustrating a control system of the entire print apparatus. Data on an image to be printed is supplied from a host computer 100 to a reception buffer 101 of a print apparatus 99. The data supplied to the reception buffer 101 is transferred to a memory unit 103 and temporarily stored in a RAM under control of a CPU 102 which is a main controller (a control unit). A mechanism controller 104 drives a mechanism unit (mecha-unit) 105 including the print heads, carriages, caps, and wipers in response to an instruction issued by the CPU 102. A sensor controller 106 transmits a signal supplied from a sensor/switch unit 107 which detects humidity, temperature, and the like to the CPU 102. An element display controller 108 controls an element display unit 109 of a display panel in response to an instruction issued by the CPU 102. A humidification controller 110 controls operation of the humidifying unit 22 illustrated in FIG. 2 in response to an instruction issued by the CPU 102. A head controller 112 drives and controls the head units 1 in response to an instruction issued by the CPU 102, and in addition, detects temperature information and the like representing states of the head units 1 to be transmitted to the CPU 102. The CPU 102 determines an amount of moisture to be supplied to the sheet 2 in accordance with parameters of an environment temperature, a sheet condition (a type and a thickness of the sheet 2), temperatures of the print heads, a print image duty, and the like. The CPU 102 performs a setting of an output of the humidified gas from the humidifying unit 22 so that the determined moisture amount is obtained.

Figure 4:
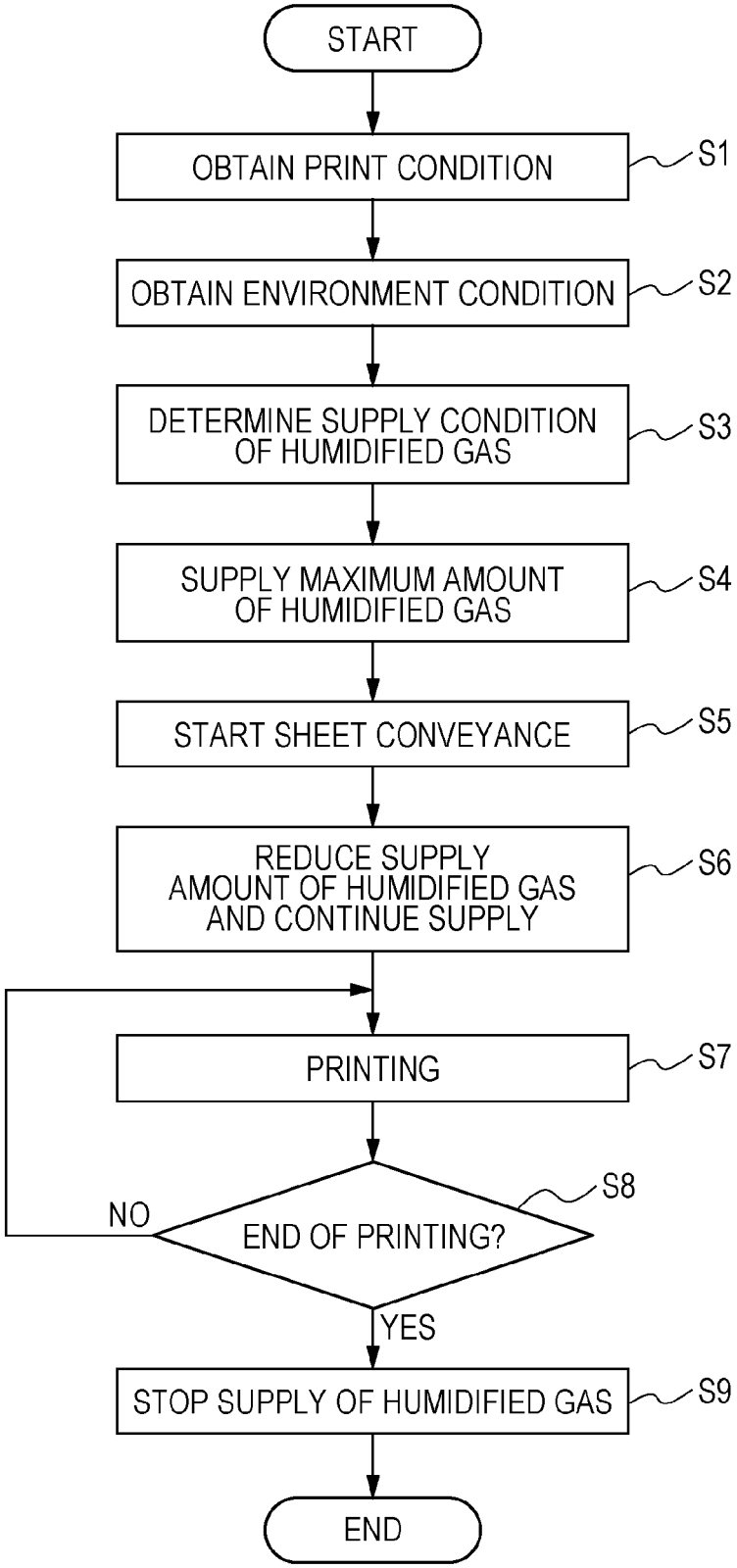
FIG. 4 is a flowchart illustrating a control sequence.

A control sequence executed by the control system will be described. FIG. 4 is a flowchart illustrating a control sequence of supplying humidified gas when a print operation is performed.

In step S1, a print condition (a sheet size, a sheet type, a sheet conveyance speed, print gaps, and the like) set in the controller 102 is obtained. In step S2, temperature and humidity which are a condition of an environment in which the print apparatus is installed are obtained by the sensor.

In step S3, a condition for supplying humidified gas is determined in accordance with the print condition obtained in step S1 and the environment condition obtained in step S2. The supply condition includes a condition of humidified gas supplied from the supply port 7 (a temperature Tm, a humidity Hm, and a blast volume Vm) and a discharge amount Ve of the humidified gas discharged from the discharge port 8. Here, the relationship represented by the following expression is satisfied: $0 \leq Ve \leq Vm$. When the supply condition is determined, a numeric value is obtained with reference to a data table stored in a memory in advance or a numeric value is obtained by calculation using a calculation equation. In the print condition, the sheet size, the sheet type (moisture absorbing property), the sheet conveyance speed (a print speed), and the print gaps may be changed depending on usage of printing. Using the information, the CPU 102 determines the condition for supplying humidified gas so that prevention of dew condensation on surfaces of components of the head units 1 and condensation in the air and prevention of drying of the nozzles are attained.

In step S4, the humidified gas is supplied from the supply ports 7 to the individual spaces 4. In an initial state in which the print apparatus is powered, humidity of the spaces 4 is the same as environmental humidity, that is, a low-humidity environment in which the nozzles easily dry. Therefore, in step S4, humidified gas is supplied at the maximum power of a flow amount of the humidifying unit 22 so that the humidity in the spaces 4 is immediately increased to desired humidity. Simultaneously with the supply, the gas in the spaces 4 is discharged from the discharge ports 8 by a flow amount the same as the supply amount. Since humidified gas is introduced into a long and narrow space from a first side and is discharged from a second side which faces the first side, the space may be filled with the humidified gas in a short time. In addition, the recycle system performed by the circulation duct 24 contributes to the reduction in time.

In step S5, sheet conveyance is started in response to an instruction for starting the print operation. The sheet 2 drawn from the roll is supplied to the print unit 5 and passes beneath the head units 1. The sheet conveyance is started simultaneously with the supply of the humidified gas performed in step S4. Note that a certain period of time is required from when the sheet 2 is drawn from the roll to when a leading end of the sheet 2 reaches the print unit, and accordingly, a timing when the sheet conveyance is started may be earlier than a timing of the supply of the humidified gas taking a time lag into consideration.

In step S6, the supply is continued while the supply amount of the humidified gas is reduced. After the spaces 4 enter a desired high humidity state, supplementary humidified gas is supplied by an amount of reduction of the humidified gas caused by introduction of the humidified gas into the print gap 32. Accordingly, unlike the operation in step S4, the humidified gas may not be continuously supplied at the maximum supply amount. Furthermore, in step S6, discharge by the discharge port 8 may be stopped or a discharge amount may be reduced. By this, energy consumption required for humidification may be suppressed.

In step S7, the print unit 5 successively prints a plurality of images on the continuous sheet 2. A flow in the boundary layer is generated on the surface of the sheet 2 in accordance with a movement of the sheet 2 in printing, and the humidified gas is supplied from the spaces 4 to portions immediately below the nozzles (print gaps). Feedback control is performed on temperature, humidity, and a flow amount of the humidified gas during the print operation so that detection outputs of the sensors (the humidity sensor and a temperature sensor) disposed in the spaces 4 become close to target values. In this way, the humidity in the spaces 4 is maintained in a target range. If the print condition has been obtained in advance and the condition is not changed, the target humidity may be maintained in the spaces 4 without the feedback control.

In step S8, it is determined whether all images have been printed (Yes or No). When the determination is negative, the process returns to step S7 and the printing is continuously performed. On the other hand, when the determination is affirmative, the process proceeds to step S9. In step S9, the supply of the humidified gas is stopped. The control sequence is thus terminated.

Figure 5A:
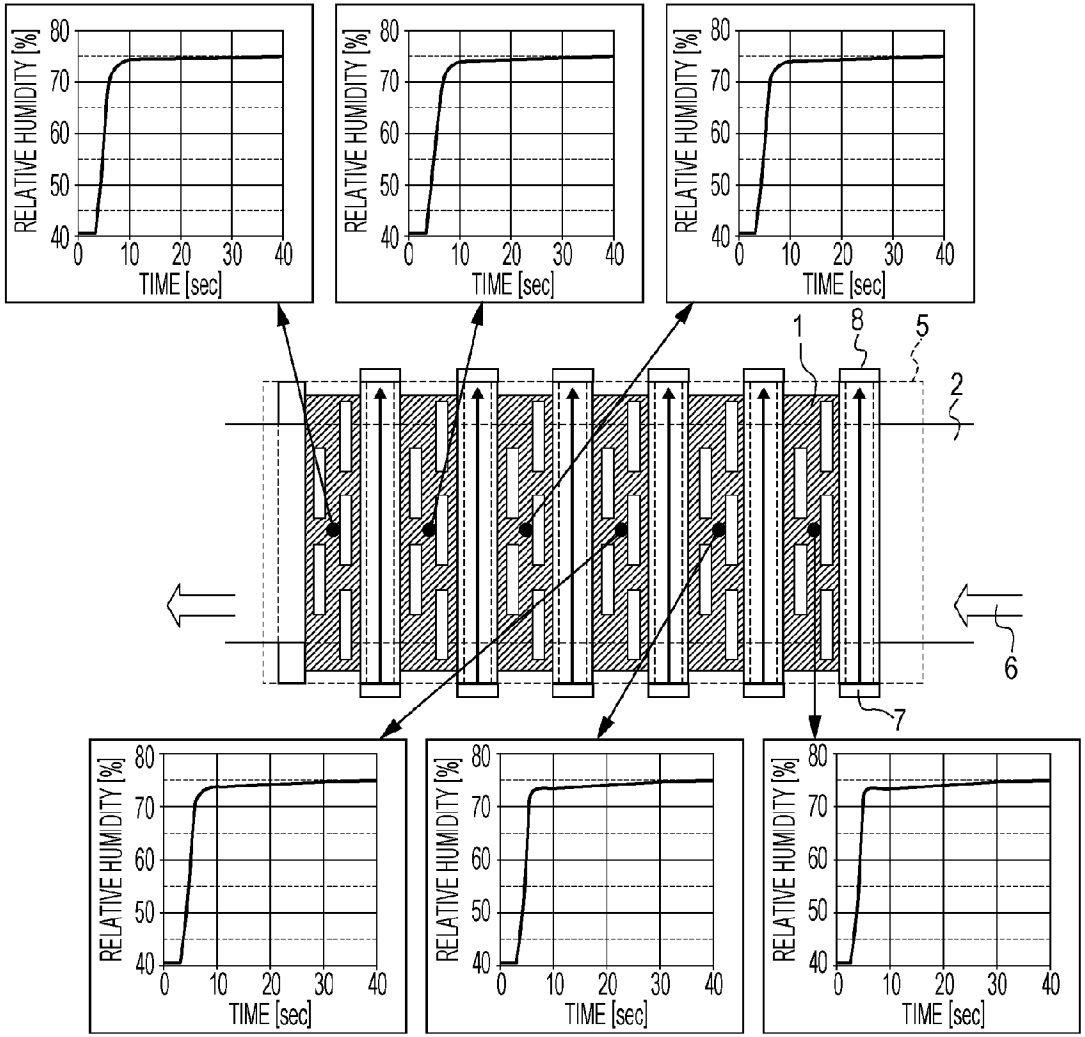
FIGS. 5A and 5B are graphs illustrating humidity change in print gaps.
Figure 5B:
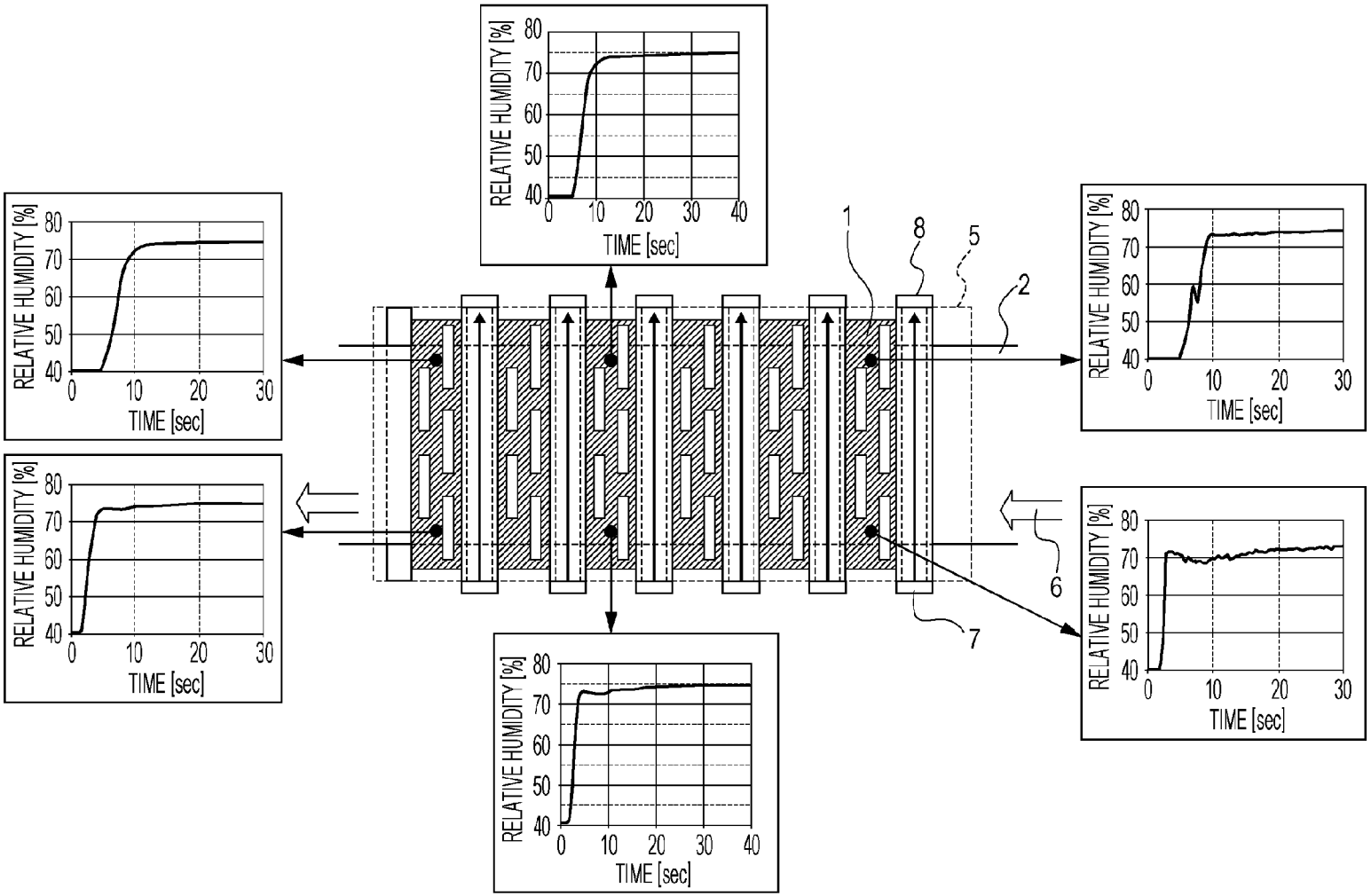

FIGS. 5A and 5B are diagrams illustrating change of humidity of the print gaps as time advances after the humidified gas is initially supplied in step S4 or step S5. Specifically, FIG. 5A is a graph illustrating time changes of the humidity in the six head units 1 at lower centers thereof. FIG. 5B is a graph illustrating time changes of humidity in portions in the vicinity of ends on the supply sides and the discharge sides of the representative three head units 1 distributed in a range from the upstream side to the downstream side.

In this example, an average of periods of time from when the supply of the humidified gas is started at individual measurement points to when a target humidity 70% is attained is five seconds. As a comparison example, when humidified air is supplied from the supply port 7 without performing discharge from the discharge port 8, an average of periods of time until the target humidity of 70% is reached is longer (8 seconds). That is, since discharge from the discharge port 8 is performed simultaneously with supply, the target humidity is reached in a short time. In addition, time differences among the plurality of measurement points are small. This may be because the humidified gas is simultaneously supplied to the plurality of spaces 4 from one side and the humidified gas is immediately spread at high speed with low flow resistances of the spaces 4.

Furthermore, in this embodiment, the sheet conveyance speed is 0.8 m/s, and an airflow speed in the small spaces corresponding to the print gaps is equal to or smaller than the sheet conveyance speed. This degree of the airflow speed hardly affects ejection of ink droplets from the nozzles. Moreover, a pressure for supplying the humidified gas to the spaces 4 from the humidifying unit 22 is approximately $1.3\times10^{-2}$ Pa, which is small, even at the maximum power in an initial state. Therefore, the size of the fans 81 and 82 may be small and power consumption thereof may be small. In addition, since the spaces 4 have low pressure inside thereof, only a small amount of gas leaks upward, and it is unlikely that moisture corrosion of the head units 1 and other electric systems occurs, which is an advantage.

In this way, according to the print apparatus of this embodiment, humidified gas may be supplied in a short time without enhancing a supply pressure of the humidified gas, and accordingly, drying of the nozzles is efficiently suppressed. As a result, a downsized print apparatus which realizes high-quality printing for a long period of time and which has a high throughput is realized.

Figure 6A:
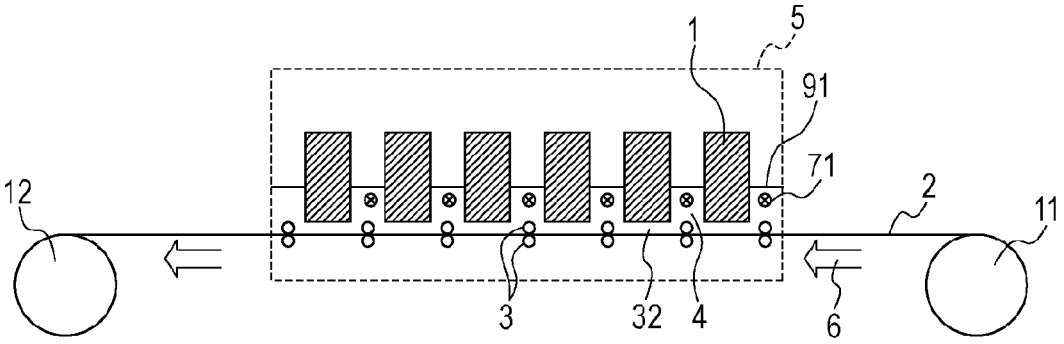
FIGS. 6A and 6B are diagrams illustrating a configuration of a modification of the embodiment.
Figure 6B:
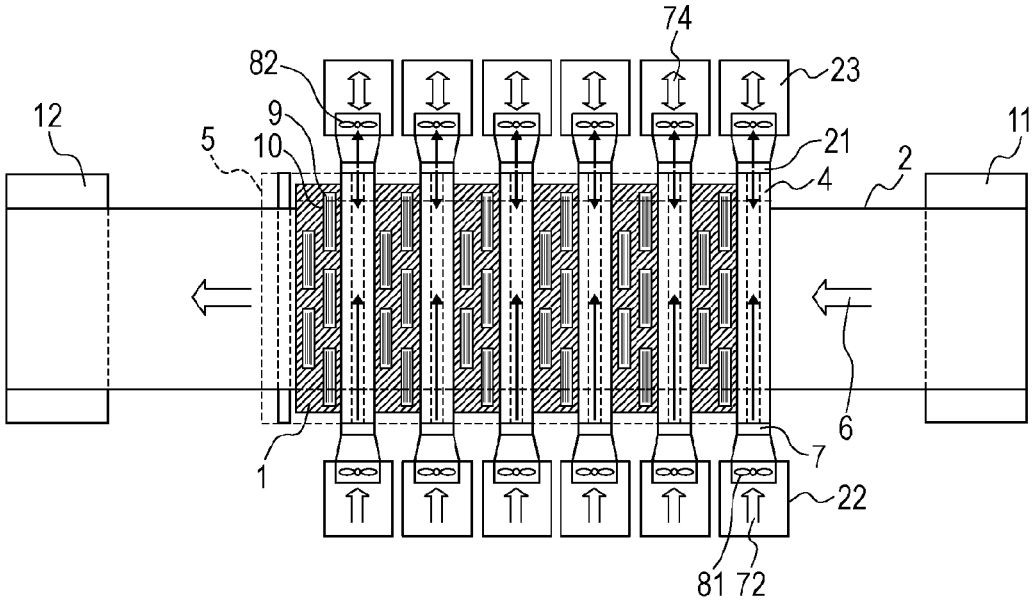

FIGS. 6A and 6B are diagrams illustrating a configuration of a modification. The modification is characterized in that a discharge port 21 facing a supply port 7 is capable of performing switching between discharge and supply of gas. When a fan 82 positively rotates, gas is discharged from a space 4 whereas when the fan 82 negatively rotates, the gas is supplied to the space 4. Note that an apparatus of FIGS. 6A and 6B may also have a recycle system using a circulation duct as illustrated in FIG. 1C.

A control sequence is the same as that illustrated in FIG. 4 except for an operation in step S6. In step S6, it is preferable that not only discharge of humidified gas is stopped but also the humidified gas is actively supplied back to the spaces 4 in some cases. For example, in a case where humidity distribution in the spaces 4 and print gaps is not uniform in low humidity portions near the discharge ports 21, the non-uniformity is suppressed by supplying the humidified gas from the discharge ports 21. In a case where non-uniform humidity distribution is generated due to condensation caused by a low-temperature component or non-uniform temperature distribution in the print heads, the non-uniformity may be suppressed by actively supplying the humidified gas from the discharge ports 21. A rotation direction and a rotation speed of the fans 82 are controlled depending on a situation.

According to the print apparatus of the present invention, humidified gas may be supplied in a short time without increasing a supply pressure of the humidified gas and drying of the nozzles is efficiently suppressed. Consequently, a downsized print apparatus which is capable of performing high-quality printing and which attains high print throughput is realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-209013, filed Oct. 10, 2014, which is hereby incorporated by reference herein in its entirety.

What is claimed is:

1. A print apparatus comprising:

a print unit configured to include a plurality of inkjet-type line print heads;

a conveying unit configured to move a sheet used for printing to be performed by the print unit; and a supply unit configured to supply humidified gas to a space between two adjacent print heads, wherein the supply unit includes a humidifying unit configured to generate the humidified gas, a supply port which is configured to supply the humidified gas generated by the humidifying unit from a side of the space, and a discharge port which is configured to discharge the humidified gas from the space, and which is disposed so as to face the supply port across the space in a direction parallel to a surface of the sheet and perpendicular to a moving direction of the sheet.

2. The print apparatus according to claim 1, wherein the two adjacent print heads are held by a head holder and the space is formed by the two adjacent print heads and the head holder.

3. The print apparatus according to claim 1, wherein the humidified gas is introduced from the space into a gap between the print heads and the sheet during printing in accordance with a movement of the sheet.

4. The print apparatus according to claim 3, wherein the humidifying unit supplies the humidified gas from the supply port before printing and reduces an amount of supply of the humidified gas during printing.

5. The print apparatus according to claim 4, wherein an amount of the discharge of the humidified gas from the discharge port during printing is reduced relative to that before the printing.

6. The print apparatus according to claim 1 further comprising:

a circulating duct configured to circulate the humidified gas discharged from the discharge port to the humidifying unit.

7. The print apparatus according to claim 1, wherein the humidified gas discharged before printing from the discharge port is resupplied to the space via the discharge port during printing.

8. A print method for performing printing on a moving sheet using a plurality of line print heads, the method comprising: supplying gas to a space between two adjacent print heads from one side of the space; and discharging the gas of the space from the other side facing the one side across the space in a direction parallel to a surface of the sheet and perpendicular to a moving direction of the sheet, thereby a gas flow is formed along the direction in the space.

9. The print method according to claim 8, wherein the print heads are inkjet-type line print heads.

10. The print method according to claim 8, wherein the two adjacent print heads are held by a head holder and the space is formed by the two adjacent print heads and the head holder.

11. The print method according to claim 8, wherein the gas is introduced from the space into a gap between the print heads and the sheet during printing in accordance with a movement of the sheet.

12. The print method according to claim 11 wherein the gas is supplied before printing and reduces an amount of supply of the gas during printing.

13. The print method according to claim 12, wherein an amount of the discharge of the gas during printing is reduced relative to that before the printing.

14. The print method according to claim 8 further comprising:

circulating the discharged gas to a humidifying unit.

15. The print method according to claim 8, wherein the gas discharged before printing is resupplied to the space via a discharge port during printing.

* * * * *